US007278885B1

(12) United States Patent
Zhang

(10) Patent No.: US 7,278,885 B1
(45) Date of Patent: Oct. 9, 2007

(54) ELECTRICAL CONNECTOR WITH SHELL

(75) Inventor: George (Huanyi) Zhang, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/633,816

(22) Filed: Dec. 5, 2006

(51) Int. Cl.
*H01R 13/648* (2006.01)

(52) U.S. Cl. ..... 439/607; 439/374

(58) Field of Classification Search ..... 439/79, 439/374, 573, 607
See application file for complete search history.

(56) References Cited

U.S. PATENT DOCUMENTS 6,086,421 A * 7/2000 Wu et al. ..... 439/607
6,361,350 B2 * 3/2002 Johnson et al. ..... 439/374
6,709,286 B1 * 3/2004 Korsunsky et al. ..... 439/557
6,722,919 B2 * 4/2004 Lin ..... 439/569
6,893,294 B2 * 5/2005 Moriyama et al. ..... 439/607
6,932,647 B2 * 8/2005 Murayama ..... 439/607
2006/0009080 A1 1/2006 Regnier et al.
2006/0014438 A1 1/2006 Regnier
2006/0040556 A1 2/2006 Neer et al.

* cited by examiner

*Primary Examiner*—Thanh-Tam Le
(74) *Attorney, Agent, or Firm*—Wei Te Chung

(57) ABSTRACT

An electrical connector (100) includes an insulated housing (1) defining a receiving passage (15), a number of terminals (2) received in the insulated housing and a metal shell (3) having a number of walls cooperatively defining a hollow (34) for receiving the insulated housing. The metal shell further has a front mating port (341) and at least one guiding member (35). The guiding member is formed on the inner surface of one wall of the metal shell and disposed in front of the insulated housing. The guiding member includes a guiding portion and a supporting portion joining to each other to form a guiding passage. The guiding passage opens towards the front mating port and is adapted for guiding a complementary connector into engagement with the electrical connector.

17 Claims, 7 Drawing Sheets

ELECTRICAL CONNECTOR WITH SHELL

CROSS-REFERENCE TO RELATED APPLICATION

This application is related to U.S. patent application entitled "ELECTRICAL CONNECTOR WITH SHELL", and it has the same applicant and assignee as the present invention. The disclosure of the related application is incorporated herein by reference.

BACKGROUND OF THE INVENTION

1. Field of the Invention

The present invention generally relates to an electrical connector, and more particularly to an electrical connector with a metal shell.

2. Description of Related Art

Low profile connectors, such as those used in SFP (Small Form Factor Pluggable) applications are desired in electronic devices in which space is at a premium and thus it is difficult to guide the opposing mating plug connectors into contact with such connectors. The plug connector typically includes a circuit card that has a projecting edge that is received within a card opening in the SFP connector. Shielding cages are typically utilized with such connectors to control the emission of electromagnetic interference. These cages often serve as a secondary housing for the connector in that they substantially enclose the connectors. The small size of the SFP style connectors makes it difficult to ensure that the opposing mating connectors mate easily with the SFP connectors, especially in a blind mating application.

For example, U.S. Pub. No. 20060040556A1 discloses an SFP-style connector with a metal shell encompassing the connector. The metal shell has an opening that defines an entrance through which an opposing mating connector may be inserted. The entrance includes one or more guide members that extend into the center of the housing and provide a guide for guiding an opposing mating connector into engagement with the circuit board connector. However, the opposing mating connector also needs corresponding keyways mating with the guiding members of the metal shell. As the guiding members may be located at different places of the metal shell and the keyways also need be defined in the different places of the opposing mating connector. However, this kind of SFP-style connectors and the opposing mating connectors are relatively complex in manufacture and costly in manufacture cost; on the other hand, it may be inconvenient for users to choose and use the SFP-style connectors and the opposing connectors. Those two shortcomings are not glad to be seen by manufacturers and customers.

Hence, an improved electrical connector with a metal shell is highly desired to overcome the disadvantages of the related art.

SUMMARY OF THE INVENTION

Accordingly, an object of the present invention is to provide an electrical connector with improved metal shell to make it easy and convenient for the electrical connector mating with the complementary mating connector.

In order to achieve the object set forth, an electrical connector in accordance with the present invention comprises an insulated housing defining a receiving passage, a plurality of terminals received in the insulated housing and a metal shell having a plurality of walls cooperatively defining a hollow for receiving the insulated housing. The metal shell further has a front mating port and at least one guiding member. The guiding member is formed on the inner surface of one side of the metal shell and disposed in front of the insulated housing. The guiding member comprises a guiding portion and a supporting portion joining to each other to form a guiding passage. The guiding passage faces to the front mating port and is adapted for guiding a complementary connector into engagement with the electrical connector.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
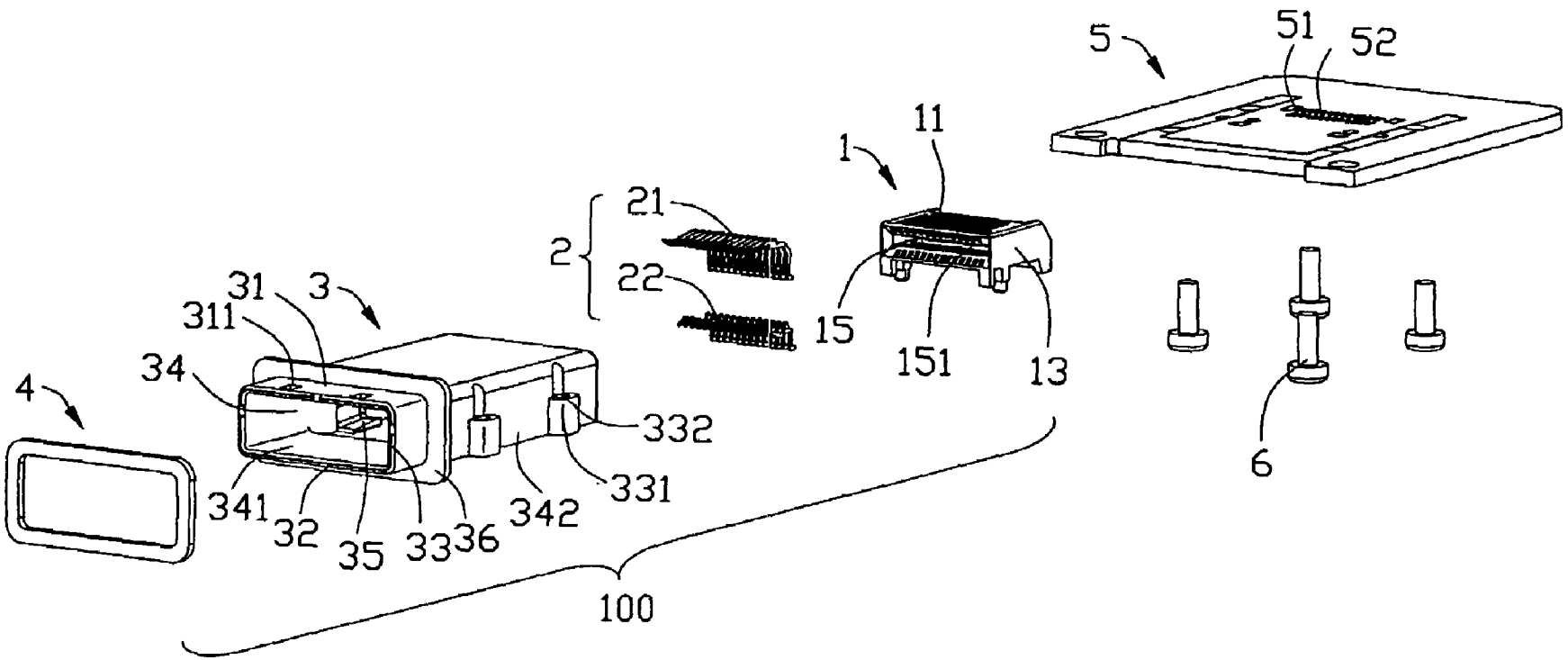
FIG. 1 is an exploded, perspective view of an electrical connector in accordance with the first embodiment of the present invention.
Figure 2:
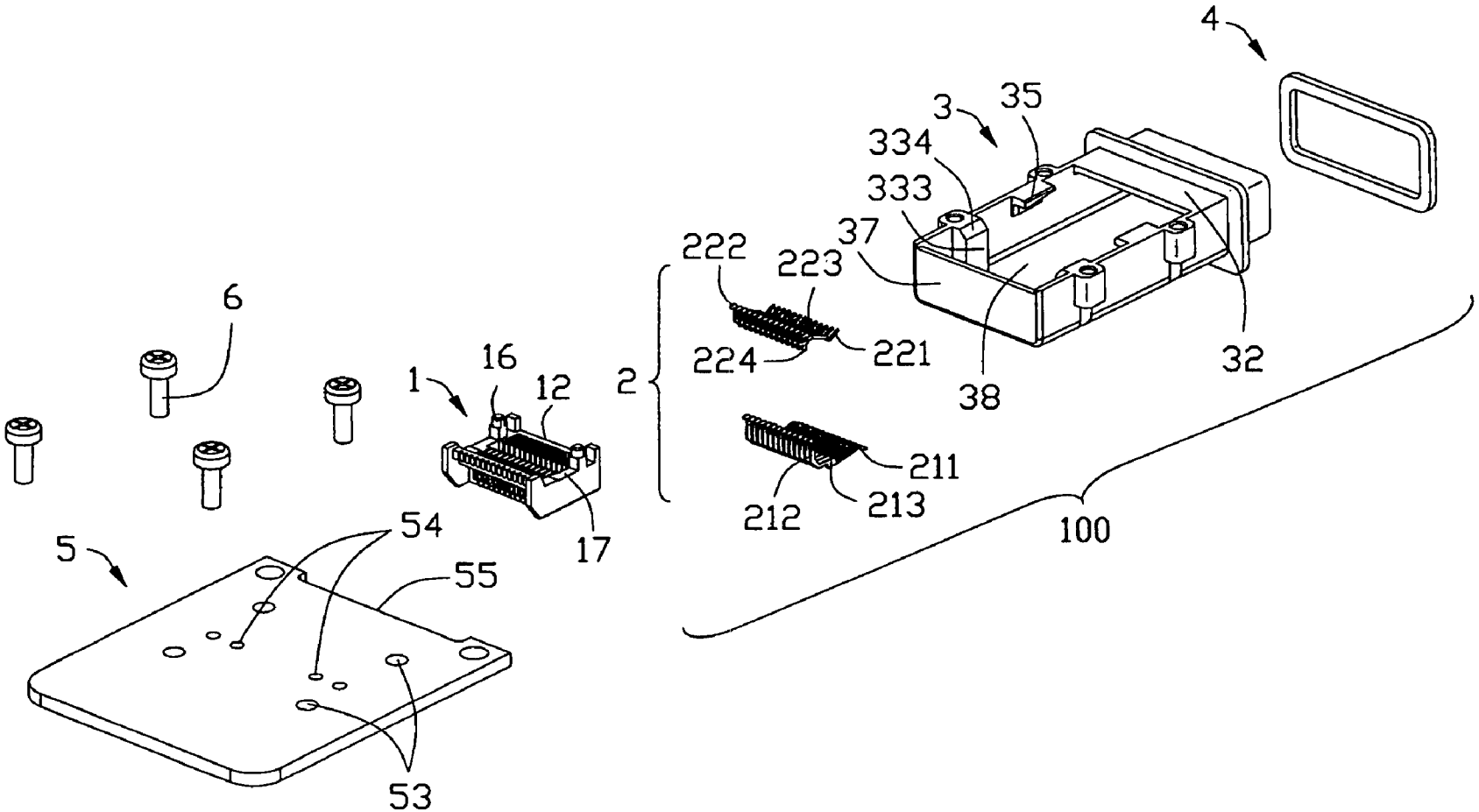
FIG. 2 is a view similar to FIG. 1, but viewed from another aspect.
Figure 4:
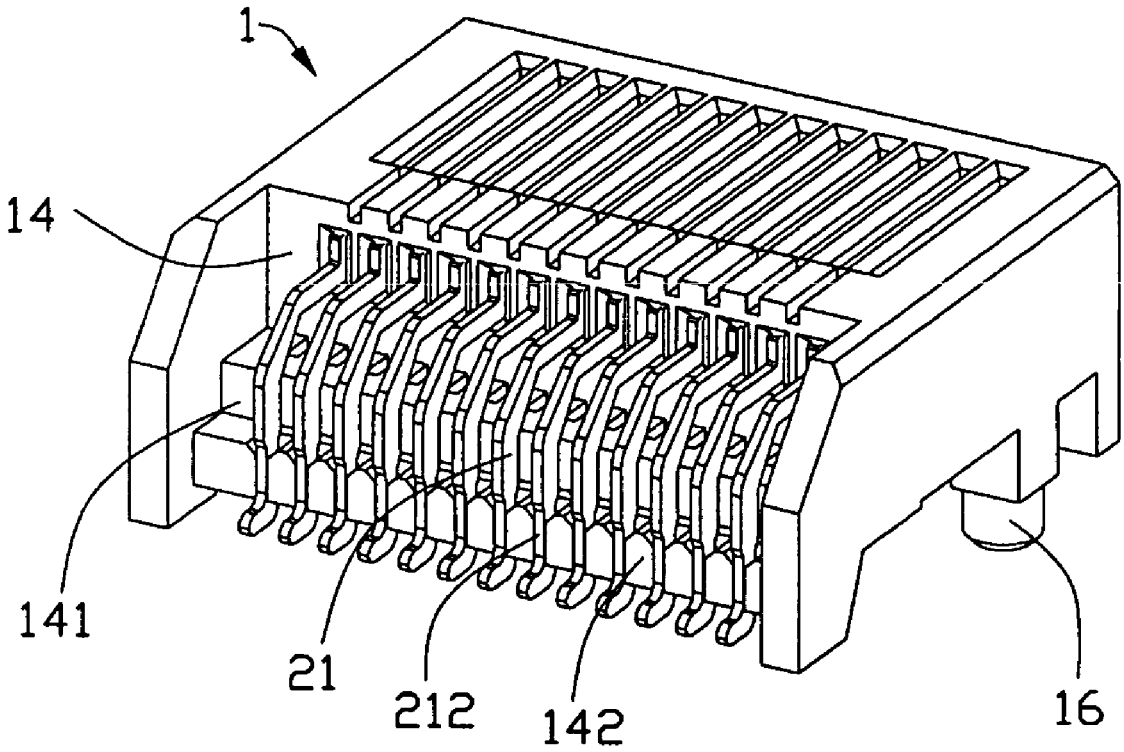
FIG. 4 is a partially assembled, perspective view of the electrical connector.

Referring to FIGS. 1, 2 and 4, an electrical connector 100 in accordance with the first embodiment of the present invention is used for provides a connection between a circuit board 5 and a complementary connector (not shown). The complementary connector has a mating portion defining a space and a printed circuit board is received in the space and a plurality of conductive pads located on the printed circuit board. The electrical connector 100 comprises an insulated housing 1, a plurality of contacts 2 respectively arranged in two rows along a vertical direction and received in the insulated housing 1, and a metal shell 3 assembled to the insulated housing 1.

The insulated housing 1 comprises a top wall 11, a bottom wall 12, a rear wall 14 and a pair of side walls 13 interconnecting with the top wall 11, the bottom wall 12 and the rear wall 14. The top wall 11, the bottom wall 12, the pair of side walls 13 and the rear wall 14 cooperatively enclose a receiving passage 15 thereamong. The receiving passage 15 has an enlarged front opening 151 communicating with itself. Each side wall 13 with part of middle portion is cut to form a gateway 17 recessed upward from the bottom edge of the side wall 13. A positioning post 16 extends downwardly from bottom surface of each side wall 13 and is adjacent to the front opening 151. Part of the rear wall 14 is cut to form a step 141 and a plurality of protrusions 142 aligning in a row along transversal direction and every two adjacent protrusions 142 are separated by a certain distance.

The terminals 2 comprise a plurality of first terminals 21 and second terminals 22 arranged in two distinct rows along vertical direction. Either row of the first terminals 21 or row of the second terminals 22 aligns along transversal direction. Each cantilever-type first terminal 21 comprises a contacting portion 211, a rear portion 212 and a body portion 213 interconnecting with the contacting portion 211 and the rear portion 212. Each cantilever-type second terminal 22 comprises a contacting portion 221, a rear portion 222, a body portion 223 interconnecting with the contacting portion 221 and the rear portion 222, and a retention portion 224 extending upward from the body portion 223.

Figure 3:
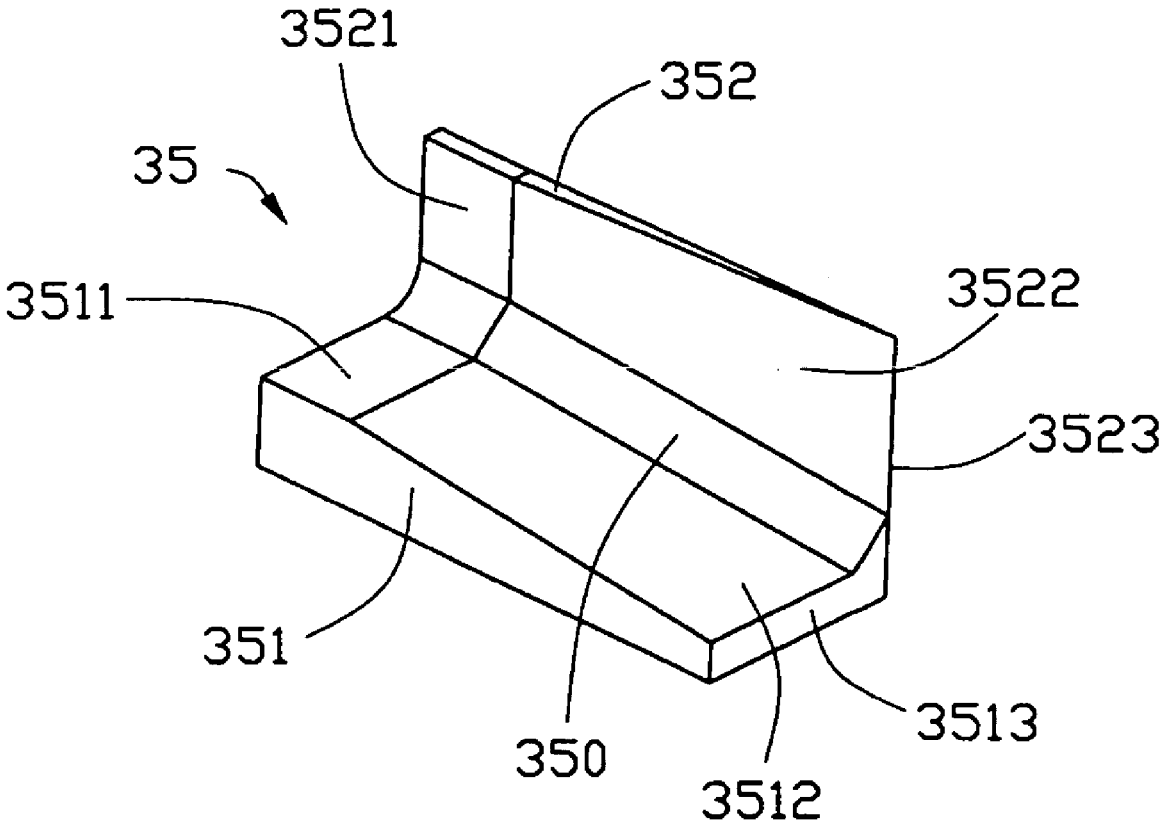
FIG. 3 is an enlarged guiding member of the electrical connector.

The metal shell 3 comprises an upper wall 31, a lower wall 32, a back wall 37 and a pair of transversal walls 33. The upper wall 31, the lower wall 32 and the back wall 37 join to the pair of the transversal walls 33, to define a hollow 34. A continues ridge 36 divides the metal shell 3 into a front mating port 341 and a rear section 342. The rear portion of the lower wall 32 is cut to form a window 38 thereon. Two guiding members 35 (FIG. 3) are respectively arranged on inner surfaces of the pair of transversal walls 33. The guiding member 35 forms substantially an L-shape guiding passage 350 and comprises a supporting portion 351 and a guiding portion 352 extending upward from one side of the supporting portion 351. The supporting portion 351 is a board body with a substantially planar upper surface 3511 and part of the front and upper board body is cut to form a first chamfer 3512, thus, the supporting potion 351 has a relative thinner front edge 3513. The vertical distance between the upper surface 3511 and the inner surface of the upper wall 31 is substantially equal to the height of the mating portion of the complementary connector. The guiding portion 352 is also a board body with a substantially planar left surface 3521 and part of the front and left board body is cut to form a second chamfer 3522, thus, the guiding portion 352 has a tapered front edge 3523. The guiding members 35 are respectively formed on the substantially middle and lower sections of the transversal walls 33, with the tapered front edge 3523 of the guiding portion 352 facing to the front mating port 341. A pair of attachment posts 331 are formed on the outer surface of each transversal wall 33. Each attachment post 331 defines a screw hole 332 therein for inserting a screw 6. A pair of vertical beams 333 are respectively formed on the inner surfaces of the transversal walls 33 and each vertical beam 333 is adjacent to the corresponding attachment post 331 near the back wall 37. The top portion of each vertical beam 333 is cut to form a chamfer 334 thereon. Pair of locking apertures 311 for latching with latch portions of a complementary connector (not shown) are defined in the front section of the upper wall 31. A gasket 4 for suppressing EMI (Electro-Magnetic Interference) is assembled to the metal shell 3 and abuts against the continuous ridge 36 of the metal shell 3.

The circuit substrate 5 has a plurality of conductive traces arranged in distinct first set of conductive traces 51 and second set of conductive traces 52. Two pairs of screw holes 53 and a pair of positioning holes 54 are respectively spaced arranged on the circuit substrate 5. A positioning cutout 55 is defined in the front portion of the circuit substrate 5.

Figure 5:
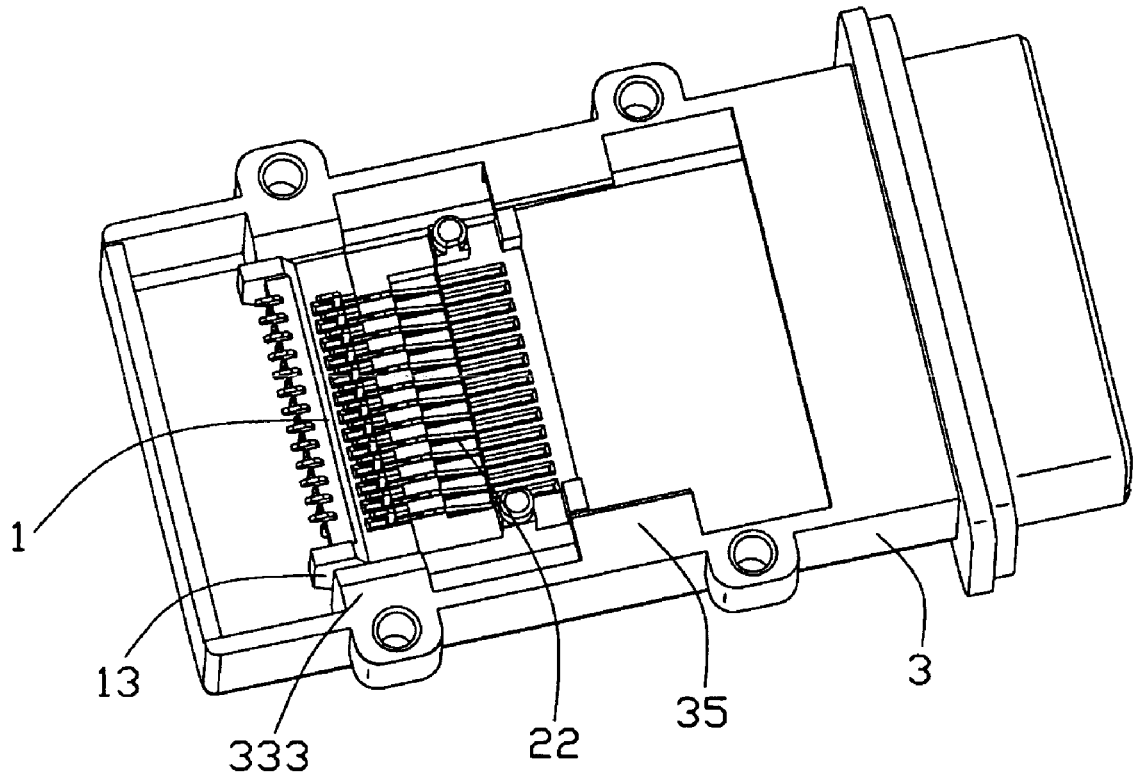
FIG. 5 is another partially assembled, perspective view of the electrical connector.
Figure 6:
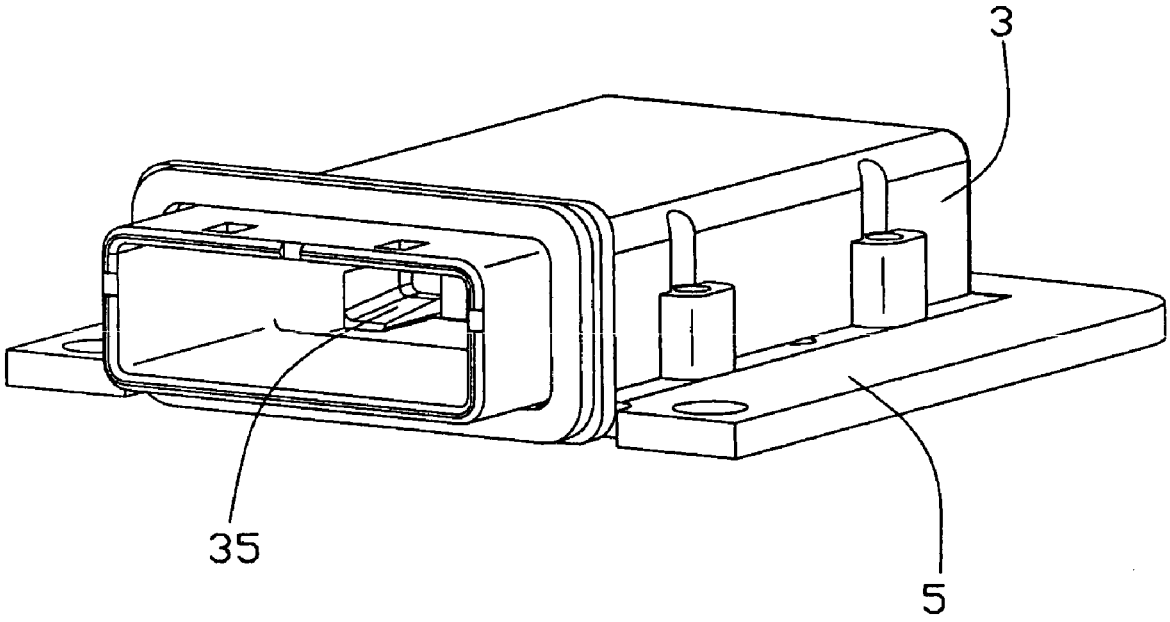
FIG. 6 is an assembled view of the electrical connector.

Referring to FIGS. 4-6 in conjunction with FIGS. 1-2, when assembly, the set of first terminals 21 are assembled to the insulated housing 1 along a front-to-back direction, with the contacting portions 211 disposed in the receiving passage 15, the body portions 213 received in the top wall 1 of the insulated housing 1, the rear portions 212 disposed on the step 141 and the ends of the rear portions 212 respectively sandwiched between two adjacent protrusions 142. While, the second set of terminals 22 are assembled to the insulated housing 1 along a vertical direction perpendicular to the front-to-back direction, with the contacting portions 221 disposed in the receiving passage 15 to face the contacting portions 211 of the first set of terminals 21, the retention portions 224 retained in the bottom wall 12 of the insulated housing 1 and the rear portions 223 disposed outwardly of the bottom wall 12. Secondly, the insulated housing 1 is assembled to the circuit substrate 5, with the positioning posts 16 inserting into the positioning holes 54 of the circuit substrate 5, the ends of the rear portions 213, 223 disposed on the first and the second conductive traces 51, 52 respectively. Thirdly, the terminals 21, 22 are soldered to the conductive traces 51, 52 by surface mount technology (SMT) manner. Gateways 17 of the insulated housing 1 facilitate the air flow in soldering process to improve the quality of solder. Fourthly, the metal shell 3 is assembled to the circuit substrate 5, with the insulated housing 1 being inserted into the hollow 34 through the windows 38 of the metal shell 3, the pair of vertical beams 333 together with the pair of supporting portions 351 of the guiding members 35 respectively sandwiching the rear sections and the front sections of the side walls 13 to position the insulated housing 1, the lower part of the protruding ridge 36 abutting against the positioning cutout 55 defined in the circuit substrate 5, the screw holes 332 of the attachment posts 331 aligning with the screw holes 53 of the circuit substrate 5. Fifthly, the metal shell 3 and the circuit substrate 5 are combined together by screws 6.

When the complementary connector (not shown) mating with the electrical connector 100, the mating portion of the complementary connector first inserts into the front mating port 341 of the metal shell 3 and enters into the hollow 34; then the mating portion of the complementary connector reaches the frontages of the guiding members 35, with the guiding of the second chamfers 3522 of the guiding portions 352 and supporting of the supporting portions 351, the mating portion of the complementary connector enters into the guiding passages 350; and then an increasing pushing force is exerted on the complementary connector and the mating portion of the complementary connector slides along the first chamfers 3512 of the supporting portions 351, until the mating portion of the complementary connector arrives at the planar upper surfaces 3511 of the supporting portions 351; lastly, the mating portion of the complementary connector moves along the planar upper surface 3511 of the supporting portion 351 forwardly and enters into the receiving passage 15 of the electrical connector 100, thus, the complementary connector matches with the electrical connector 100 easily and accurately.

Figure 7:
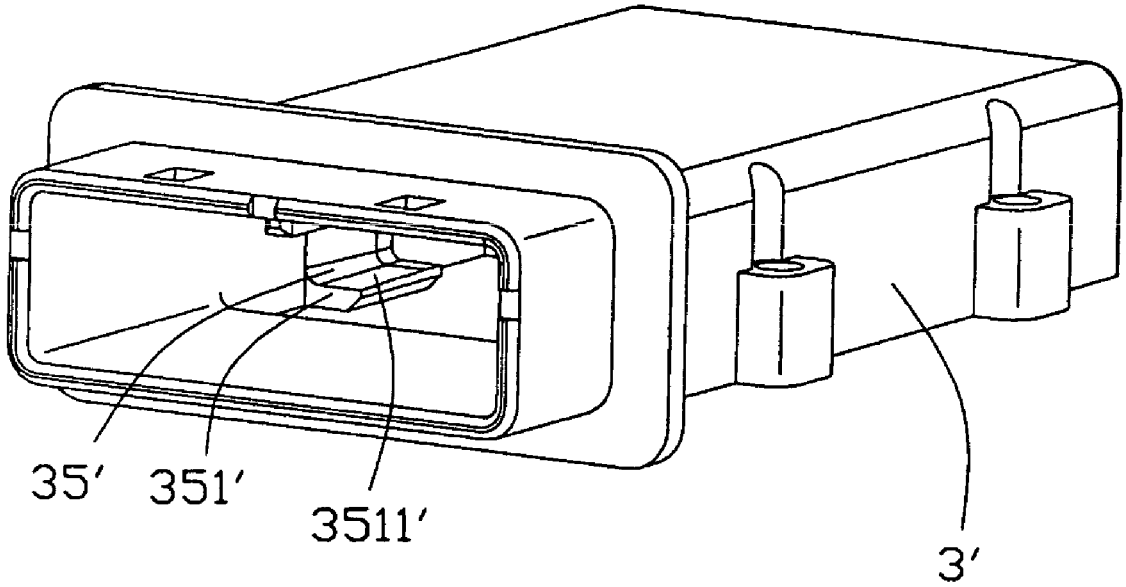
FIG. 7 is a metal shell of an electrical connector in accordance with the second embodiment of the present invention.

Referring to FIG. 7, an electrical connector 100' in accordance with the second embodiment of the present invention is illustrated. In comparison with the first embodiment of the present invention, the structure of the electrical connector 100' is same as that of the electrical connector 100 except for guiding members 35'. The guiding member 35' is the same as the guiding member 35 of the first embodiment except that the upper surface 3511' of the supporting portion 351' is a substantially planar-type and hasn't such first chamfer 3512 as that defined on the guiding member 35 of the first electrical connector 100. In comparison with the mating process of the electrical connector 100 together with the complementary connector, the mating process of the electrical connector 100' together with the complementary connector is same as the electrical connector 100 with the complementary connector, except that there is no subprocess that the mating portion of the electrical connector

100' slides along the first chamfer, and the mating portion of the complementary connector directly slides along the planar upper surface 3511' and also matches with the electrical connector 100' accurately.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. An electrical connector for providing a connection between a printed circuit board and a complementary connector, said printed circuit board having a plurality of conductive traces disposed thereon, comprising:

an insulated housing defining a receiving passage;

a plurality of terminals received in the insulated housing;

a metal shell having a plurality of walls cooperatively defining a hollow for receiving the insulated housing, said metal shell defining a front mating port; and at least one guiding member formed on an inner surface of one wall of the metal shell and disposed in front of the insulated housing when the insulated housing inserted into the metal shell, said guiding member comprising a guiding portion and a supporting portion joining to each other to form a guiding passage, said guiding passage facing to the front mating port;

wherein said guiding portion is integrally formed with one of the walls of the metal shell and said supporting portion extends into the hollow;

wherein the guiding portion is a board body with a substantially planar surface and part of a front and a top board body is cut to form a chamfer thereon;

wherein the metal shell comprises an upper wall, a lower wall, a back wall and a pair of transversal walls, and wherein the upper wall, the lower wall and the back wall join to the pair of the transversal walls to form the hollow with the front mating port; and wherein the guiding portion is formed on an inner surface of one of the transversal walls.

2. The electrical connector as claimed in claim 1, wherein the transversal walls respectively form a pair of vertical beams, and wherein the pair of vertical beams sandwich two sides of the insulated housing to make the metal shell and the insulated housing combine together.

3. The electrical connector as claimed in claim 1, wherein part of a rear section of the lower wall is cut to form a window, and wherein the insulated housing is put into the hollow from the window.

4. The electrical connector as claimed in claim 1, wherein the upper wall defines a pair of locking apertures in front part of the upper wall for latching with latch portions of the complementary connector.

5. The electrical connector as claimed in claim 1, wherein each transversal wall forms at least one attachment post on the outer surface of the each transversal wall, and wherein the attachment post defines a screw hole therein.

6. The electrical connector as claimed in claim 1, wherein a front portion of the metal shell has a continuous ridge adapted for abutting against a positioning cutout of the printed circuit board.

7. The electrical connector as claimed in claim 1, wherein the terminals are separated into a set of first terminals and a set of second terminals, and wherein the set of first terminals and the set of second terminals are assembled to the insulated housing along different directions which are perpendicular to each other.

8. The electrical connector as clamed in claim 7, wherein the set of first terminals are assembled to the insulated housing along a front-to-back direction and the set of second terminals are assembled to the insulated housing along a vertical direction perpendicular to the front-to-back direction.

9. The electrical connector as claimed in claim 7, wherein the insulated housing comprises a bottom wall, and wherein each second terminal has a retention portion and the retention portion is retained in the bottom wall.

10. The electrical connector as claimed in claim 7, wherein the insulated housing further comprises a rear wall forming a plurality protrusions extending rearward therefrom, and wherein each first terminal has a rear portion and the rear portion is sandwiched between two adjacent protrusions.

11. The electrical connector as claimed in claim 1, wherein the insulated housing further comprises a pair of side walls, and wherein a pair of positioning posts extend downwardly from bottom of the side walls respectively.

12. The electrical connector as claimed in claim 11, wherein each side wall with part of middle portion defines a gateway recessed upward from the bottom surface of the side wall.

13. An electrical connector comprising:

an insulated housing defining a receiving passage;

a plurality of terminals received in the insulated housing and communicating with the receiving passage;

a metal shell enclosing the insulated housing, and circumferentially defining a front mating port which is essentially far spaced from the receiving passage;

a printed circuit board located outside and under both the housing and the shell, on which both said housing and said shell are mounted; and at least one guiding member located in front of the receiving passage when the insulated housing inserted into the metal shell and in the front mating port, said guiding member comprising a standing guiding portion and a lying supporting portion joining to each other to form a guiding passage, and at least one of said standing guiding portion and said lying supporting portion being forwardly and downwardly tapered;

wherein the metal shell defines an outwardly radially peripheral flange around a front section thereof while with a distance from a front edge of said metal shell, and a front edge of said printed circuit board is terminated behind said flange, and said guiding member is located behind said flange;

wherein the standing guiding portion is a board body with a substantially planar surface and part of a front and a top board body is cut to form a chamfer thereon;

wherein the metal shell comprises an upper wall, a lower wall, a back wall and a pair of transversal walls, and wherein the upper wall, the lower wall and the back wall join to the pair of the transversal walls to form a hollow with the front mating port; and wherein the standing guiding portion is formed on an inner surface of one of the transversal walls.

14. The electrical connector as claimed in claim 13, wherein a cutout is formed in said front edge of the printed circuit board, in which a portion of said flange is received.

15. An electrical connector comprising:

an insulated housing defining a receiving passage;

a plurality of terminals received in the insulated housing and communicating with the receiving passage;

a metal shell enclosing the insulated housing, and circumferentially defining a front mating port which is essentially far spaced from the receiving passage;

a printed circuit board located outside and under both the housing and the shell, on which both said housing and said shell are mounted; and at least one guiding member located in front of the receiving passage when the insulated housing inserted into the metal shell and in the front mating port, said guiding member comprising a standing guiding portion and a lying supporting portion joining to each other to form a guiding passage, and said standing guiding portion and said lying supporting portion both formed at a same corner in the mating port;

wherein the standing guiding portion is a board body with a substantially planar surface and part of a front and a top board body is cut to form a chamfer thereon;

wherein the metal shell comprises an upper wall, a lower wall, a back wall and a pair of transversal walls, and wherein the upper wall, the lower wall and the back wall join to the pair of the transversal walls to form a hollow with the front mating port; and wherein the standing guiding portion is formed on an inner surface of one of the transversal walls.

16. The electrical connector as claimed in claim 15, wherein the metal shell defines an outwardly radially peripheral flange around a front section thereof while with a distance from a front edge of said metal shell, and a front edge of said printed circuit board is terminated behind said flange, and said guiding member is located behind said flange.

17. The electrical connector as claimed in claim 16, wherein wherein a cutout is formed in said front edge of the printed circuit board, in which a portion of said flange is received.

* * * * *